US007070073B2

(12) United States Patent
Damrath et al.

(10) Patent No.: US 7,070,073 B2
(45) Date of Patent: Jul. 4, 2006

(54) PRESSING DUMMY WITH STIFFENING DEVICE AT THE SLEEVE END

(75) Inventors: Joachim Damrath, Bachhagel (DE); Kathrin Redlin, Berlin (DE); Markus Spielmannleitner, Ellwangen (DE); Bodo Urich, Berlin (DE); Gerhard Wetzl, Sontheim (DE)

(73) Assignee: BSH Bosch und Siemens Hausgeräte, Munich (DE)

( * ) Notice: Subject to any disclaimer, the term of this patent is extended or adjusted under 35 U.S.C. 154(b) by 332 days.

(21) Appl. No.: 10/601,543

(22) Filed: Jun. 23, 2003

(65) Prior Publication Data

US 2004/0003519 A1 Jan. 8, 2004

Related U.S. Application Data

(63) Continuation of application No. PCT/EP01/14114, filed on Dec. 3, 2001.

(30) Foreign Application Priority Data

Dec. 22, 2000 (DE) ..... 100 64 320

(51) Int. Cl.
*D06C 15/00* (2006.01)

(52) U.S. Cl. ..... 223/72; 223/52.1; 223/67

(58) Field of Classification Search ..... 223/52.1, 223/67, 72, 52, 66; 38/85, 88, 1 B
See application file for complete search history.

(56) References Cited

U.S. PATENT DOCUMENTS

| | | | | |
|---|---|---|---|---|
| 2,417,838 A | | 3/1947 | Paris | |
| 2,883,092 A | | 4/1959 | McMillan | |
| 3,279,662 A | * | 10/1966 | Pearson | 223/73 |

FOREIGN PATENT DOCUMENTS

| | | |
|---|---|---|
| EP | 0 193 483 A1 | 9/1986 |
| FR | 1.273.992 | 9/1960 |

* cited by examiner

*Primary Examiner*—Gary L. Welch
(74) *Attorney, Agent, or Firm*—John T. Winburn; Russell W. Warnock; Craig J. Loest

(57) ABSTRACT

A method and a device for ironing items of clothing with sleeves, especially, shirts and blouses, by a form finisher include an inflatable bag placed inside the item of clothing when it is being ironed. The inflatable bag extends to the sleeves of the item of clothing. For the sleeves to be ironed in a smoother manner, the ends of the inflatable bag can be provided with a reinforcement that extends to the sleeves. Also, to enable the vents, which are situated above the sleeves, to keep their shape (the overlap und underlap), the inflatable bag can also be supplied, therefore, with reinforcement. An inner tensioning mechanism that is inserted inside the area of the sleeve can improve the smoothness even further.

35 Claims, 2 Drawing Sheets

PRESSING DUMMY WITH STIFFENING DEVICE AT THE SLEEVE END

CROSS-REFERENCE TO RELATED APPLICATION

This application is a continuation of copending International Application No. PCT/EP01/14114, filed Dec. 3, 2001, which designated the United States and was not published in English.

BACKGROUND OF THE INVENTION

FIELD OF THE INVENTION

The invention relates to a method of, and an apparatus for, pressing items of clothing with sleeves—in particular shirts and blouses—by a pressing dummy.

The prior art discloses a variety of apparatuses for pressing items of clothing by a pressing dummy. European Patent Application EP 0 193 483 A1 (subsequent application to French Patent Document Registration No. 8500673, corresponding to French Patent Publication No. 2,575,773) describes a method of, and a pressing dummy for, pressing an item of clothing. The item of clothing in this case, for pressing purposes, is pulled onto an inflatable bag of the pressing dummy. An air stream, in the interior of the inflatable bag, blows through the bag and the item of clothing, in which case the item of clothing is, then, dried and pressed. Because the inflatable bag also projects into the sleeves of the item of clothing, these sleeves are also dried. In one configuration of the invention, the inflatable bag is extended beyond the cuffs (and possibly also beyond the collar) of the item of clothing. Flexible flaps are fitted on the outside of these extensions. They are, preferably, made of the same material as the inflatable bag. If the item of clothing is, then, positioned on the pressing dummy and the air stream is activated, the air flows simultaneously through the inflatable bag and the flaps together. The air stream, then, inflates the inflatable bag and the flaps. The inflatable bag then positions itself against the item of clothing from the inside. The flaps, however, position themselves on the cuffs of the item of clothing from the outside. Because the drying air also flows through the flaps, the cuffs are dried from the inside by way of the inflatable bag and from the outside by way of the flaps.

If the item of clothing is to be removed from the pressing dummy again following drying, then the flaps, first of all, have to be folded over manually in the other direction before the item of clothing can be pulled off the pressing dummy. This is a time-consuming and laborious task. It is additionally problematic if, each time the item of clothing is fitted and pulled off, the sleeve of the item of clothing, in particular, the cuffs, get caught on the flaps. Cuffs that have just been pressed may become creased again in the process.

The above-described prior art also gives rise to a further disadvantage: cuffs of an item of clothing are usually button-fastening and, thus, have a slit above the cuff (that is to say, in the direction of the shoulder of the item of clothing). Because the inflatable bag inflates during drying, it pushes against this slit and opens it. The disadvantage, then, is that a slit that is so opened is dried in this form, although, for esthetic reasons, this is not desired.

SUMMARY OF THE INVENTION

It is accordingly an object of the invention to provide a pressing dummy with stiffening measures at the sleeve end that overcomes the hereinafore-mentioned disadvantages of the heretofore-known devices of this general type and that provides a method and an apparatus (in the form of a pressing dummy) that eliminate, or at least reduce, the above-described disadvantages.

With the foregoing and other objects in view, there is provided, in accordance with the invention, an apparatus for pressing items of clothing having sleeves with cuffs and a slit disposed above the cuff, including a pressing dummy having an inflatable bag projecting into a region of the cuffs of the clothing item when the clothing item is place on the dummy for drying, supporting, and shaping the sleeve during a pressing operation and a stiffening device supporting and shaping the clothing item in a region of the slit during the pressing operation. Preferably, the clothing item is a shirt or a blouse.

It has been found that it is also possible for the cuffs to be pressed by direct or indirect stiffening of the inflatable bag in the region of the sleeve ends. That is to say, that the stiffening device is only disposed on the inside of the item of clothing, and that there is no need for any disruptive flaps beneath the cuffs, as in the case of the prior art. Direct stiffening is intended to mean that the inflatable bag is, itself, stiffened. Indirect stiffening is intended to mean a stiffening device that is realized by an additional part on the inflatable bag—once again, only in the sleeve region of the item of clothing. These stiffening device all have the advantage that they are easy to realize.

Within the context of the invention, this stiffening device may be disposed either just in the region of the cuff or just between the cuff and the shoulder region of the item of clothing (that is to say, above the cuff) or also in both regions.

In accordance with another feature of the invention, the stiffening device may be provided in the material of the inflatable bag. Thus, for example, it is conceivable to have stiff materials woven into the inflatable bag. It is also possible, however, for the inflatable bag to be impregnated—at least at certain points—with liquids that, once hardened, provide the inflatable bag with the necessary stability.

If the pressing dummy functions such that an air stream dries the item of clothing from its interior, then it is advantageous if the stiffening device is of air-permeable configuration. It is, thus, also possible for the drying air to flow through the item of clothing, and, thus, dry it, in the region of the stiffening device. If small holes with sufficiently small diameters are provided in the stiffening device, then the stiffening device is sufficiently stable, air can flow through it, and the inflatable bag cannot be pushed through the holes and deform the item of clothing in the process.

A special form of the stiffening device is provided by a fitting a stiffening part onto the inflatable bag. This stiffening part will be referred to hereinbelow as a slit tongue. This slit tongue serves—as its name suggests—for stiffening the inflatable bag in the region of the slit above the cuff of the item of clothing and is in the form of a tongue, or, more precisely, of a shoehorn. It is, thus, no longer possible for this slit to be widened by the inflatable bag. It is also the case for the slit tongue that, for operation of the pressing dummy with a drying-air stream from its interior, the slit tongue should, preferably, be of an air-permeable configuration—for example, by holes. It is also possible here for the slit tongue, or the stiffening device in general, to be of an air-impermeable configuration.

So that this slit tongue maintains its hold on the inflatable bag, it is possible for at least one of its ends to engage in a tab—which is, for example, sewn on the inflatable bag. By virtue of the tab, it is more easily possible to compensate for relative movement between the slit tongue and the inflatable bag because the slit tongue can slide in the tab.

It is also possible, however, for the slit tongue to have at least one end fitted directly—for example, by adhesive bonding—on the inflatable bag. It goes without saying that because such a slit tongue has two ends, both possible fastening methods are also combined. The slit tongue may be fastened on, or adhesively bonded to, the inflatable bag on the inside or outside.

In accordance with an added feature of the invention, the stiffening device is also provided in a region of the cuff to support and to shape the cuff during pressing.

It may be advantageous if the cuff of the clothing item is retained during pressing. The cuff, thus, achieves better seating and is, therefore, pressed more reliably. It is particularly practical if, for such a purpose, a clip is integrally formed, in a releasable or fixed manner, on the slit tongue. Because the clip acts on the outside of the cuff, it is advantageous for it, too—regardless of whether the drying-air stream comes from the outside or inside—to be air-permeable, so that drying is not obstructed by parts lying on top. The air permeability may be produced, once again, by holes.

In accordance with a further feature of the invention, the air permeability is deliberately prevented. Because the end surface of the bottom end of the inflatable-bag part that is located in the sleeve of the item of clothing does not have any drying functions, it is advantageous if no useful drying air passes out of the end surface during operation of the pressing dummy with an air stream from its interior.

The pressing force of the inflatable bag is often insufficient to press the cuff of the item of clothing to a sufficient extent. In order, nevertheless, to achieve a satisfactory result, a tensioning mechanism may be disposed in the inflatable bag in the region of the cuff. This tensioning mechanism, then, expediently includes, for example, two tensioning jaws that—loaded by a spring—are supported one upon the other.

With the objects of the invention in view, there is also provided an apparatus for pressing items of clothing having sleeves with cuffs and a slit disposed above the cuff, including a pressing dummy having an inflatable bag projecting into a region of the cuffs of the clothing item when the clothing item is place on the dummy for drying, supporting, and shaping the sleeve during a pressing operation and a stiffening means for supporting and shaping the clothing item in a region of the slit during the pressing operation.

With the objects of the invention in view, there is also provided a, apparatus for pressing items of clothing having sleeves with cuffs and a slit disposed above the cuff, including a pressing dummy having an inflatable bag projecting into a region of the cuffs of the clothing item when the clothing item is place on the dummy for drying, supporting, and shaping the sleeve during a pressing operation, the inflatable bag has a tab and an air-permeable stiffening device supporting and shaping the clothing item in a region of the slit during the pressing operation, the stiffening device having ends, being fastened on the inflatable bag, the tab retaining the stiffening device by at least one of the ends, and being disposed in a region of the cuff to support and to shape the cuff during pressing.

Other features that are considered as characteristic for the invention are set forth in the appended claims.

Although the invention is illustrated and described herein as embodied in a pressing dummy with stiffening devices at the sleeve end, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
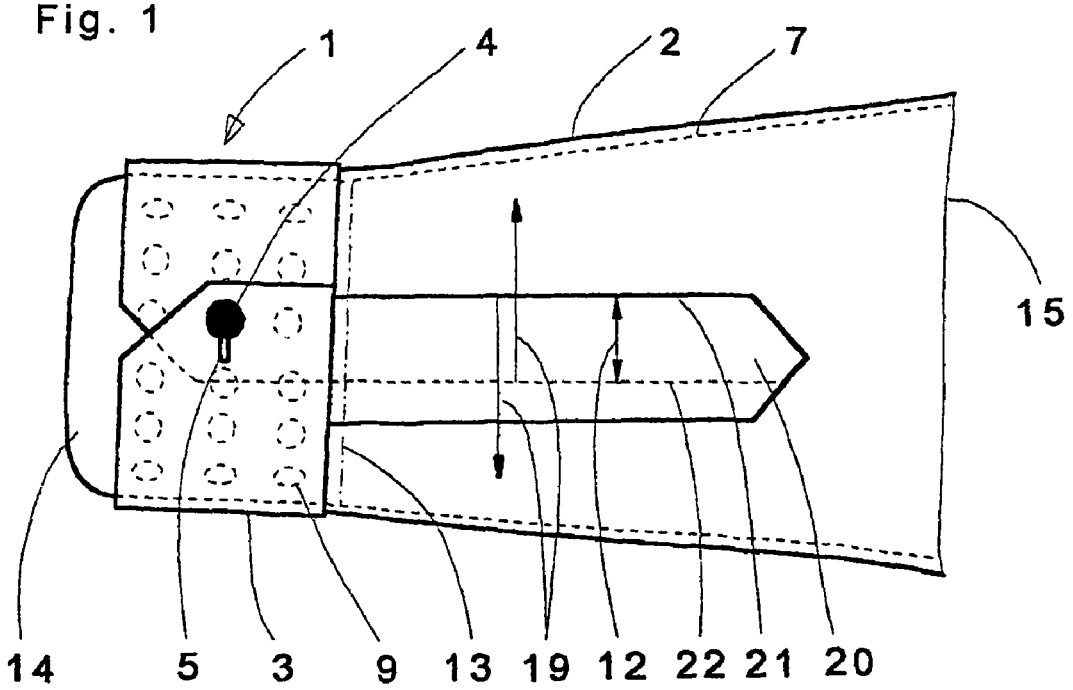
FIG. 1 is a fragmentary, plan elevational view of part of a pressing dummy and of an item of clothing with a stiffening device according to the invention in the region of a cuff.

Referring now to the figures of the drawings in detail and first, particularly to FIG. 1 thereof, there is shown a stiffening device of the inflatable bag 7 in the region of a button-fastening cuff 3 of an item of clothing 2. This stiffening device performs the function of a cuff presser 1. The stiffening device of the cuff presser 1 has rendered the latter impermeable to air. It is, thus, provided with air holes 9 so that the air stream can also dry the cuff 3. The bottom end of the inflatable bag (in this case, on the left-hand side of FIG. 1) has an air-impermeable region 14 so that useful drying air cannot penetrate uselessly in the outward direction. Once the item of clothing 2 has been pulled onto the pressing dummy (as illustrated in FIG. 1 of co-pending U.S. patent application Ser. No. 10/601,544, filed on Jun. 20, 2003, the disclosure of which being hereby incorporated by reference) and the cuff 3 has been buttoned, it is possible for the air stream for the inflatable bag 7 to be switched on. Because the cuff presser 1 is provided with air holes, the drying air penetrates outward through these holes and dries and presses the cuff 3 in the process. The stiffening device is delimited from the rest of the inflatable bag 7 and of the item of clothing 2 by a boundary line 13. This region of the sleeve 15 is characterized by a slit in the fabric. The overlapping fabric in the region of the slit is also referred to as an upper piece 21. The fabric located therebeneath is referred to as an underpiece 22. The outer, narrow strip of fabric that tapers to a point (to the right in the case of FIG. 1) is referred to as a facing 20. At least a double layer of fabric is, thus, produced in the region 12. During operation of the pressing dummy, the air in the inflatable bag 7 forces the constituent parts of the region 12 apart from one another. The upper piece 21 and the underpiece 22 are moved in an expansion direction 19. If the fabric of the item of clothing 2 is not stiff enough in relation to the pressure in the inflatable bag 7, this may result in unintended deformation of the item of clothing 2 in this region.

Figure 2:
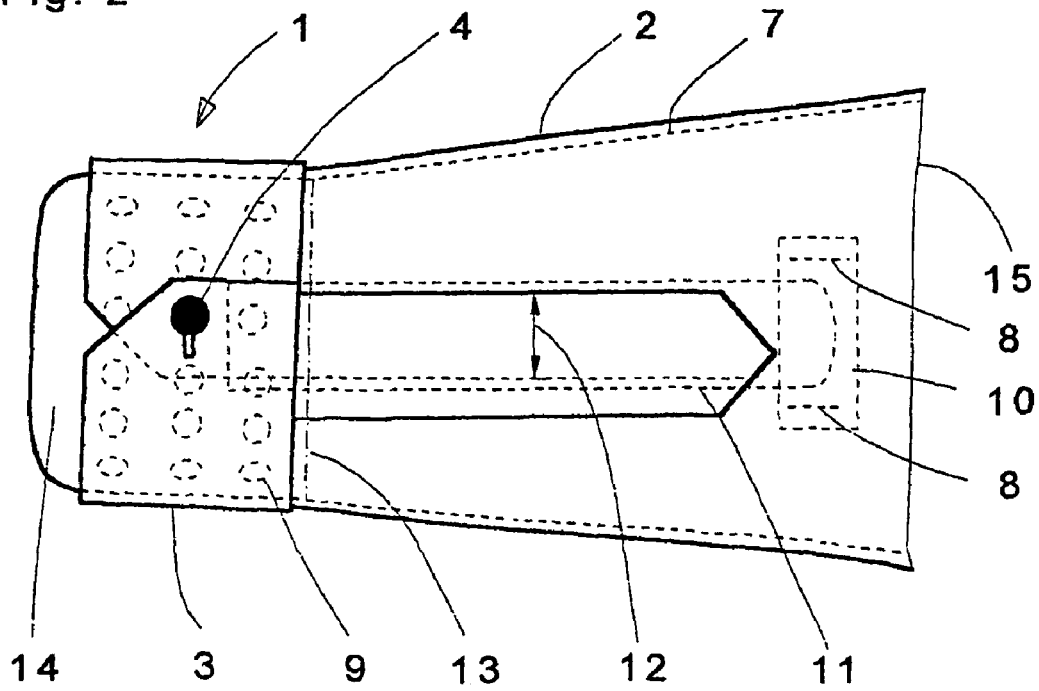
FIG. 2 is a fragmentary, plan elevational and partially hidden view of the device of FIG. 1, but with an additional stiffening device (a slit tongue) in the region above the cuff.

FIG. 2, then, is intended to show a way for combating deformation in the region of the upper piece 21 and underpiece 22. In this case, use is made, in addition to the cuff presser 1, of a stiffening device in the form of a slit tongue 11. This slit tongue 11 is retained by a tab 10 at one end (in this case on the right with regard to FIG. 2). The tab 10 is fastened on the inflatable bag 7 by seams 8. The other end of the slit tongue 11, in this exemplary embodiment, is fastened on the inflatable bag 7 in the vicinity of the cuff 3.

By virtue of stiffening with the aid of the slit tongue 11, the upper piece 21 and the underpiece 22 are, indeed, also subjected to a compressive force but, because the slit tongue 11 is pushed flat and also, on account of its rigidity, allows virtually no curvature, the slit is not widened to any significant extent.

Figure 3:
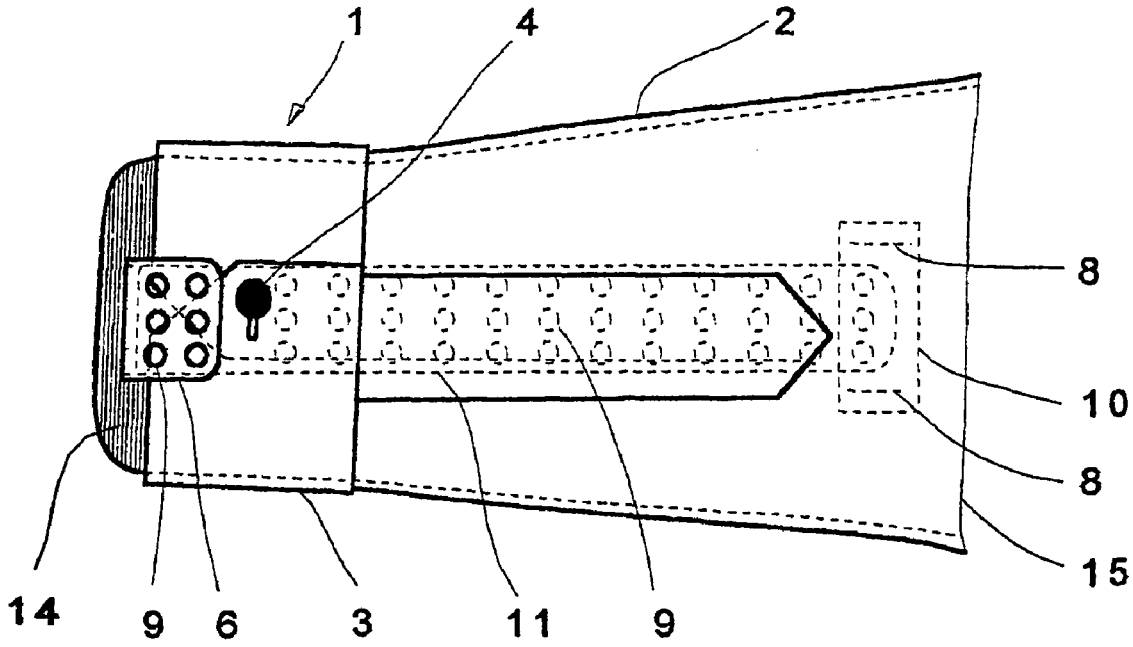
FIG. 3 is a fragmentary, plan elevational and partially hidden view of the device of FIG. 2, but with a clip integrally formed on the slit tongue.

FIG. 3 illustrates a further configuration of the invention. So that the slit tongue 11—in the case of a drying-air stream from the interior of the inflatable bag 7—does not obstruct the drying of the item of clothing 2, it is provided with air holes 9. The slit tongue 11 is, additionally, provided with a clip 6. This clip 6, in this case, is integrally formed in a fixed manner on the slit tongue 11. Because the slit tongue 11 is disposed between the inflatable bag 7 and the item of clothing 2 and the clip 6 engages around the cuff 3, the cuff 3 is, thus, retained and also shaped. For better air permeability, the clip 6 is also provided with air holes 9.

The cuff presser 1 in the exemplary embodiment is no longer characterized by an additional stiffening device in the region of the cuff 3. It is, nevertheless, also possible, here, to refer to a cuff presser 1 because the inflated inflatable bag 7, likewise, has a tensioning and, thus, also a pressing action. The inflatable bag 7 in this example is air-permeable throughout in the region of the item of clothing 2. For illustrative purposes, in FIG. 3, hatching has, thus, been used to emphasize the air-impermeable region 14 on the end surface of the inflatable bag 7, in contrast to FIGS. 1 and 2.

Figure 4:
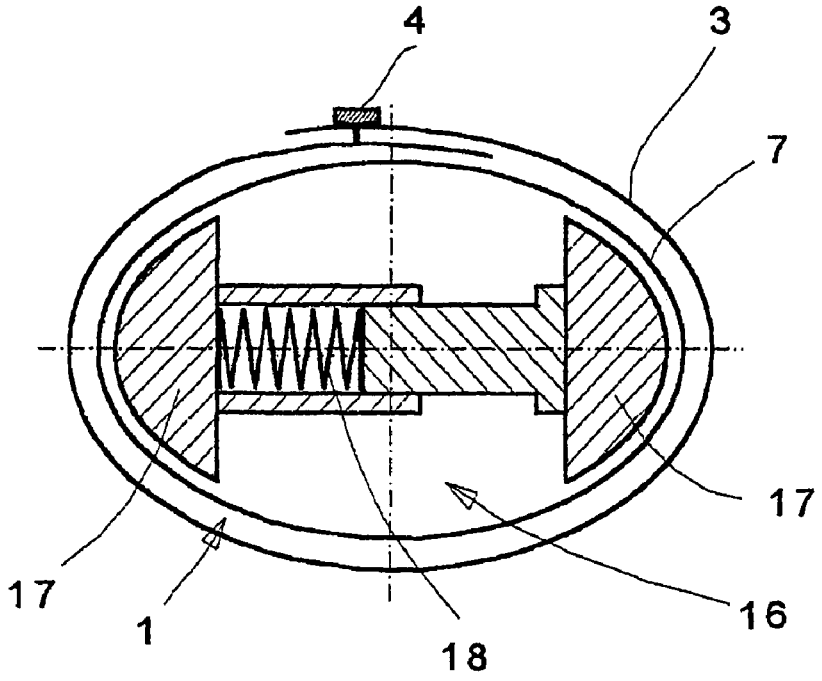
FIG. 4 is a cross-sectional view through the region of a shirt cuff with a tensioning mechanism according to the invention for the cuff.

The cross-section illustrated in FIG. 4 is intended to illustrate a possible tensioning mechanism 16 for the cuff 3 of an item of clothing 2. So that the ellipsoidal lines in FIG. 4 do not merge one into one another, they have been spaced at a clear distance apart from one another for illustrative purposes. In reality, they lie directly upon one another. A button 4 closes the cuff 3. The inflatable bag 7 is located further toward the inside. Two tensioning jaws 17 press against the inflatable bag 7 from the inside. This pressing force results from the spring 18, which forces the guided tensioning jaws 17 apart from one another. Although the tensioning jaws 17 do not fill the entire circumference of the cuff 3, this is not necessary for a satisfactory pressing result. This is because, if the tensioning jaws 17 tension the ellipse in the longitudinal direction in the manner shown, then it is, nevertheless, possible for the air stream in the inflatable bag 7 to achieve curvature of the cuff 3 that, although slight, then produces a considerable tangential tensioning action.

So that the tensioning jaws 17 do not block the access of a drying-air stream (if it is coming from the interior of the inflatable bag) to the cuff 3, the tensioning jaws 17 may be provided with non-illustrated air holes 9.

For relatively easy changeover of an item of clothing 2 in the region of the cuff 3, all that is required is for the tensioning mechanism 16 to be pushed together briefly by the fingers of one hand.

We claim:

1. An apparatus for pressing items of clothing having sleeves with cuffs and a slit disposed above the cuff, comprising:

a pressing dummy having an inflatable bag projecting into a region of the cuffs of the clothing item when the clothing item is place on the dummy for drying, supporting, and shaping the sleeve during a pressing operation;

a stiffening device supporting and shaping the clothing item in a region of the slit during the pressing operation; and wherein said stiffening device is air-permeable.

2. The apparatus according to claim 1, wherein said stiffening device is a tongue-shaped slit tongue.

3. The apparatus according to claim 1, wherein said stiffening device is a shoehorn-shaped slit tongue.

4. The apparatus according to claim 1, wherein said stiffening device is also provided in a region of the cuff to support and to shape the cuff during pressing.

5. The apparatus according to claim 4, wherein said stiffening device has an inner tensioning mechanism in a region of the cuff when in the pressing operation.

6. The apparatus according to claim 5, wherein said tensioning mechanism has two tensioning jaws supported one upon another.

7. The apparatus according to claim 1, wherein said stiffening device has at least one air hole.

8. The apparatus according to claim 1, wherein:

said inflatable bag is of a material; and said stiffening device is disposed in said material of said inflatable bag.

9. The apparatus according to claim 1, wherein said inflatable bag has an end region adjacent the cuff when in the pressing operation and an air-impermeable region at said end region.

10. The apparatus according to claim 1, wherein the clothing item is a shirt or a blouse.

11. An apparatus for pressing items of clothing having sleeves with cuffs and a slit disposed above the cuff, comprising:

a pressing dummy having an inflatable bag projecting into a region of the cuffs of the clothing item when the clothing item is place on the dummy for drying, supporting, and shaping the sleeve during a pressing operation;

a stiffening device supporting and shaping the clothing item in a region of the slit during the pressing operation; and wherein said stiffening device is fastened on said inflatable bag.

12. The apparatus according to claim 11, wherein:

said inflatable bag has a tab fitted thereon;

said stiffening device has ends; and said tab retains said stiffening device by at least one of said ends.

13. The apparatus according to claim 12, wherein said stiffening device is a slit tongue and is fitted by at least one of said ends directly on said inflatable bag.

14. The apparatus according to claim 11, wherein:

said stiffening device has ends; and said stiffening device is a slit tongue and is fitted by at least one of said ends directly on said inflatable bag.

15. An apparatus for pressing items of clothing having sleeves with cuffs and a slit disposed above the cuff, comprising:

a pressing dummy having an inflatable bag projecting into a region of the cuffs of the clothing item when the clothing item is place on the dummy for drying, supporting, and shaping the sleeve during a pressing operation;

a stiffening device supporting and shaping the clothing item in a region of the slit during the pressing operation; and a clip for fixing the cuff integrally formed on said stiffening device.

16. The apparatus according to claim 15, wherein said clip is air-permeable.

17. The apparatus according to claim 15, wherein said clip has at least one air hole.

18. An apparatus for pressing items of clothing having sleeves with cuffs and a slit disposed above the cuff, comprising:

a pressing dummy having an inflatable bag projecting into a region of the cuffs of the clothing item when the clothing item is place on the dummy for drying, supporting, and shaping the sleeve during a pressing operation;

a stiffening device supporting and shaping the clothing item in a region of the slit during the pressing operation; and wherein said stiffening device has an inner tensioning mechanism in a region of the cuff when in the pressing operation.

19. The apparatus according to claim 18, wherein said tensioning mechanism has two tensioning jaws supported one upon another.

20. A method for pressing items of clothing, which comprises:

placing a clothing item having sleeves with cuffs and a slit disposed above the cuff on a pressing dummy; and carrying out a pressing operation of the item by:

projecting an inflatable bag of the pressing dummy into a region of the cuffs when the item is placed on the dummy for drying;

supporting and shaping the sleeve with the inflatable bag during the pressing operation; and supporting and shaping a region of the slit with a stiffening device during the pressing operation; and providing the stiffening device as an air-permeable stiffening device.

21. The method according to claim 20, which further comprises providing the pressing dummy with a tongue-shaped slit tongue as the stiffening device.

22. The method according to claim 20, which further comprises providing the pressing dummy with a shoehorn-shaped slit tongue as the stiffening device.

23. The method according to claim 20, which further comprises supporting and shaping the cuff during pressing by providing the stiffening device in a region of the cuff.

24. The method according to claim 23, which further comprises providing the stiffening device with an inner tensioning mechanism in a region of the cuff during the pressing operation.

25. The method according to claim 24, which further comprises providing the tensioning mechanism with two tensioning jaws supported one upon another.

26. The method according to claim 20, which further comprises providing the stiffening device with at least one air hole.

27. The method according to claim 20, which further comprises placing the stiffening device in a material of the inflatable bag.

28. The method according to claim 20, which further comprises fastening the stiffening device on the inflatable bag.

29. The method according to claim 28, which further comprises:

fitting a tab on the inflatable bag; and retaining the stiffening device with the tab by at least one end of the stiffening device.

30. The method according to claim 29, which further comprises removably fixing the cuff with a clip integrally formed on the stiffening device.

31. The method according to claim 28, which further comprises:

providing the stiffening device as a slit tongue; and fitting the slit tongue by at least one of the ends thereof directly on the inflatable bag.

32. The method according to claim 20, which further comprises:

providing an end region of the inflatable bag adjacent the cuff during the pressing operation; and providing the end region with an air-impermeable region.

33. The method according to claim 20, which further comprises providing the stiffening device with an inner tensioning mechanism in a region of the cuff during the pressing operation.

34. The method according to claim 33, which further comprises providing the tensioning mechanism with two tensioning jaws supported one upon another.

35. The method according to claim 20, providing the clothing item as a shirt or a blouse.

* * * * *